US007440714B2

(12) United States Patent
Kosako

(10) Patent No.: US 7,440,714 B2
(45) Date of Patent: Oct. 21, 2008

(54) METHOD AND APPARATUS FOR IMAGE FORMING CAPABLE OF EFFECTIVELY ADJUSTING RESPECTIVE PHASES OF IMAGE BEARING MEMBERS

(75) Inventor: Jun Kosako, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 369 days.

(21) Appl. No.: 11/376,063

(22) Filed: Mar. 16, 2006

(65) Prior Publication Data

US 2006/0210313 A1 Sep. 21, 2006

(30) Foreign Application Priority Data

Mar. 16, 2005 (JP) ..... 2005-076024

(51) Int. Cl.
*G03G 15/00* (2006.01)
*G03G 15/01* (2006.01)

(52) U.S. Cl. ..... 399/167; 399/301

(58) Field of Classification Search ..... 399/49, 399/167, 299, 301; 347/116
See application file for complete search history.

(56) References Cited

U.S. PATENT DOCUMENTS 6,278,857 B1 * 8/2001 Monji et al. ..... 399/301
7,103,302 B2 * 9/2006 Kameyama ..... 399/167
7,239,829 B2 * 7/2007 Tanaka ..... 399/167
7,352,978 B2 * 4/2008 Ebara et al. ..... 399/49

FOREIGN PATENT DOCUMENTS

JP 2002-014504 1/2002
JP 2004-144919 5/2004

* cited by examiner

*Primary Examiner*—William J Royer
(74) *Attorney, Agent, or Firm*—Oblon, Spivak, McClelland, Maier & Neustadt, P.C.

(57) ABSTRACT

An image forming apparatus includes a plurality of photoreceptors configured to bear respective images, a phase detecting unit configured to perform a phase detection so as to detect respective phases of the plurality of photoreceptors, a phase adjusting unit configured to perform a phase adjustment so as to adjust the respective phases of the plurality of photoreceptors to become in predetermined correlated phase relationships, based on an output from the phase detecting unit, and a control unit configured to specify a first form of an image forming operation in which the phase detecting unit performs the phase detection during a printing operation, and the phase adjusting unit performs the phase adjustment while the plurality of photoreceptors are rotating after a completion of the printing operation so that the plurality of photoreceptors are stopped in the predetermined correlated phase relationships.

20 Claims, 12 Drawing Sheets

METHOD AND APPARATUS FOR IMAGE FORMING CAPABLE OF EFFECTIVELY ADJUSTING RESPECTIVE PHASES OF IMAGE BEARING MEMBERS

CROSS REFERENCE TO RELATED APPLICATIONS

The present patent application claims priority to Japanese patent application no. 2005-076024, filed in the Japan Patent Office on Mar. 16, 2005, the entire disclosure of which is hereby incorporated by reference herein in its entirety.

BACKGROUND OF THE INVENTION

1. Field of the Invention

The present invention relates to a method and apparatus for image forming preferably applicable for a printer, facsimile machine, copier, multi-functional machine, and so forth. More particularly, the present invention relates to an image forming apparatus that can effectively adjust respective phases of a plurality of image bearing members to become correlated in phase relationships so that a printing operation can instantly be started.

2. Discussion of the Background Art

Some background image forming apparatuses have a tandem-type structure in which a plurality of image forming mechanisms respectively form toner color images corresponding to different color components according to respective image data.

When a recording medium passes the plurality of respective image forming mechanisms, respective timings of passing the plurality of respective image forming mechanisms corresponding to respective color components are different from each other. Therefore, a write start timing in a sub-scanning direction in the respective image forming mechanisms are adjusted by a light beam emission start timing. That is, when a light beam deflected according to the image data of the corresponding color toner image is emitted from an optical writing unit, the start timing of emitting the laser beam is required to be controlled such that each single color toner image can properly be overlaid at a transfer position in the image forming mechanism onto the recording medium closely attached onto the sheet transfer belt.

However, another control other than the control of the write start timing is required to obtain a preferable transfer image. That is, a plurality of photoreceptors that ideally have a cross-sectional circular form and rotate around a center axis of the circular form may have eccentricity and deviate from the center axis of rotation, as shown in FIGS. 1A and 1B. The cause of the eccentricity or deviation is based on limitations of maintaining the manufacturing accuracy and/or the assembly accuracy of each photoreceptor, which is unavoidable.

When the rotation axis becomes eccentric, a circumferential speed of a photoreceptor 901 with respect to a transfer belt 902 may vary according to a rotational phase of the photoreceptor 901. That is, the circumferential speed of the photoreceptor 901 with respect to the transfer belt 902 may be different between a condition when a rotation radius of the photoreceptor 901 reaches its maximum value as shown in FIG. 1A and a condition when the rotation radius of the photoreceptor 901 reaches its minimum value as shown in FIG. 1B.

Therefore, when an image of lines of a laser beam is written onto a circumferential surface of the photoreceptor 901 as shown in FIG. 2A, the image of lines may be written at even intervals at constant rotations as shown in FIG. 2B. However, the circumferential speed may become different according to the rotational phase of the photoreceptor 901. Therefore, when transferred onto the recording medium, the image of lines may be written at uneven intervals caused by variations of the circumferential speed of the photoreceptor 901, as shown in FIG. 2C.

To compensate for the variation of the circumferential speed of the photoreceptor, a write timing can be varied according to the phase of the photoreceptor. For example, intervals of writing can be set smaller when the circumferential speed is in a fast phase, and conversely, intervals of writing can be set greater when the circumferential speed is in a slow phase. By performing the above-described operations, color shifts on an overlaid image due to rotational phase shifts of each photoreceptor may be prevented.

When a series of image forming operations, however, are performed without properly adjusting the relationship of phase in respective photoreceptors to a predetermined condition that is a reference of a phase correction of write timing, the overlaid (and printed) image may have color shifts caused by rotational phase shifts of a photoreceptor as shown in FIG. 3.

Thus, it is preferable that the phases of the respective photoreceptor are adjusted to a predetermined phase relationship prior to the start of the image forming operations start so as to obtain a preferable overlaid image.

To adjust the phases of the respective photoreceptor to a predetermined phase relationship, it is preferable to perform a phase detecting operation and a phase adjusting operation prior to a series of image forming operations. The phase detecting operation is performed to detect phases of the respective photoreceptor. The phase adjusting operation is performed to adjust the phases of the photoreceptor detected through the phase detecting operation to the predetermined phase relationship.

A phase detecting operation that is widely known is performed in the steps noted below.

When a print request from a user is received, an image forming apparatus starts to rotate a plurality of photoreceptors, and detects respective rotational phases of corresponding each of the plurality of photoreceptors. Thereby, phases of each photoreceptor can be detected.

In the phase detecting operation, a measurement start point detected by a photointerruptor and so forth is specified as an origin, and pulses generated with respect to rotation angles of the respective photoreceptors are adjusted by using a rotary encoder with an incremental method.

Further, the phase adjusting operation is performed by increasing or decreasing the rotational speeds of the respective photoconductors so that current rotational phases, which are detected values, of the respective photoreceptors and the predetermined phase relationship, which are target values, of the respective photoreceptors are compensated.

In the background art, the above-described phase detecting and adjusting operations are performed after a printing operation is requested by a user, and then the actual image forming operation is started to discharge the printouts out of the image forming apparatus.

The above-described phase detecting and adjusting operations of a photoreceptor, however, are performed during a period from a receipt of the print request to a production of printouts, that is, prior to a start of the actual image forming operation. Therefore, a period of time required to obtain the desired printouts may seem long to users.

Some techniques have shown a variety of ways to reduce the phase adjustment time.

However, these techniques have shown that the phase detecting and adjusting operations of the photoreceptors are performed during the period of time from the receipt of the print request to the start of the actual image forming operation. Even if the period of time required for the phase detecting and adjusting operations is reduced, these operations need to be performed before the start of the actual image forming operation. Therefore, the waiting time that is the operation period may still seem long for users.

SUMMARY OF THE INVENTION

The present patent application has been made in view of the above-mentioned circumstances.

An object of the present patent application is to provide a novel image forming apparatus that can detect and adjust rotational phases of respective image bearing members while the respective image bearing members are rotating in the course of an image forming operation.

Another object of the present patent application is to provide a novel method of adjusting the rotational phases of the respective image bearing members included in the above-described novel image forming apparatus.

In one embodiment, a novel image forming apparatus includes a plurality of photoreceptors configured to bear respective images on respective surfaces thereof, a phase detecting unit configured to perform a phase detection so as to detect respective phases of the plurality of photoreceptors, a phase adjusting unit configured to perform a phase adjustment so as to adjust the respective phases of the plurality of photoreceptors to become in predetermined correlated phase relationships, based on an output from the phase detecting unit, and a control unit configured to specify a first form of an image forming operation in which the phase detecting unit performs the phase detection during a printing operation, and the phase adjusting unit performs the phase adjustment while the plurality of photoreceptors are rotating after a completion of the printing operation so that the plurality of photoreceptors are stopped in the predetermined correlated phase relationships.

The control unit may further be configured to specify a second form of image forming operation in which the phase detecting unit performs the phase detection prior to a start of the printing operation, the phase adjusting unit performs the phase adjustment so that the respective phases of the plurality of photoreceptors become the predetermined correlated phase relationships, and the printing operation is started after the phase adjustment.

The control unit may be configured to select one of the first and second forms of image forming operations in accordance with a setting input to the control unit.

The second form of image forming operation may be selected regardless of the setting of the control unit in a case in which at least one of the plurality of photoreceptors is not rotated in the printing operation and the at least one of the plurality of photoreceptors is rotated in the following printing operation.

The novel image forming apparatus may further include a plurality of photoreceptor drive units configured to drive the plurality of photoreceptors. One of the plurality of photoreceptor drive units may drive two or more photoreceptors of the plurality of photoreceptors in conjunction with each other, and the two or more photoreceptors may be regarded as one single photoreceptor in the phase detection and the phase adjustment.

The novel image forming apparatus may further include a reference photoreceptor setting unit configured to specify one of the plurality of photoreceptors as a reference photoreceptor for adjusting the respective phases of the plurality of photoreceptors.

The novel image forming apparatus may further include a first storing unit configured to store a value specified by the reference photoreceptor setting unit.

The reference photoreceptor setting unit may be configured to specify the reference photoreceptor in accordance with a request from one of a local apparatus and a remote apparatus via a network.

The novel image forming apparatus may further include a phase difference setting unit configured to specify respective phase differences of respective non-reference photoreceptors with respect to the reference photoreceptor.

The novel image forming apparatus may further include a second storing unit configured to store values specified by the phase difference setting unit.

The phase difference setting unit may be configured to specify the phase difference in accordance with a request from one of a local apparatus and a remote apparatus via a network.

In another embodiment, a novel method of adjusting rotational phases of image bearing members includes receiving a request of printing an image from one of a local apparatus and a remote apparatus via a network, rotating the plurality of photoreceptors, and performing one of first and second forms of image forming operations based on a setting specified in the request. The first form of image forming operation includes detecting respective phases of the plurality of photoreceptors during a printing operation, adjusting the respective phases of the plurality of photoreceptors to become in predetermined correlated phase relationships, based on the detecting, while the plurality of photoreceptors are rotating after a completion of the printing operation, and stopping the plurality of photoreceptors in the predetermined correlated phase relationships. The second form of image forming operation includes detecting the respective phases of the plurality of photoreceptors prior to a start of the printing operation, adjusting the respective phases of the plurality of photoreceptors to become in predetermined correlated phase relationships, based on the detecting, and starting the printing operation.

The method may further include specifying a reference photoreceptor, storing a value for the reference photoreceptor, specifying respective phase differences of respective non-reference photoreceptors with respect to the reference photoreceptor, and storing values for the respective non-reference photoreceptors.

Further, in another embodiment, a computer program product stored on a computer readable storage medium carries out a method of adjusting a plurality of photoreceptors, as described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1A:
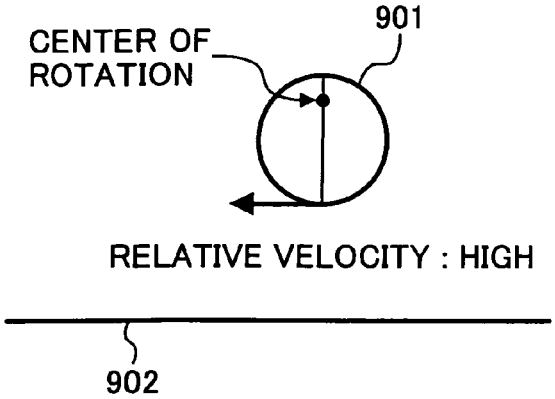
FIG. 1A BACKGROUND ART
FIGS. 1A and 1B show a relationship of a photoreceptor and a transfer belt in a background image forming apparatus.
Figure 1B:
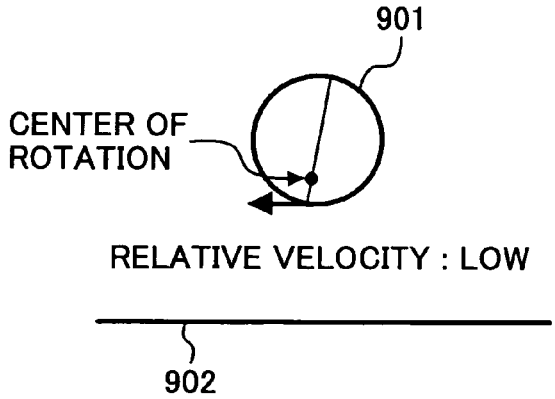
FIG. 1B BACKGROUND ART
Figure 2A:
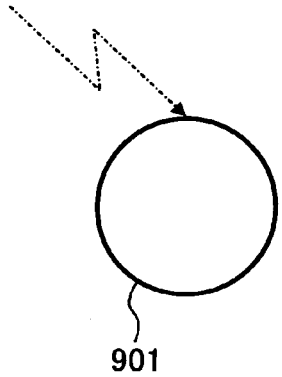
FIG. 2A BACKGROUND ART
FIG. 2A shows a photoreceptor irradiated by a light beam of the background image forming apparatus.
Figure 2B:
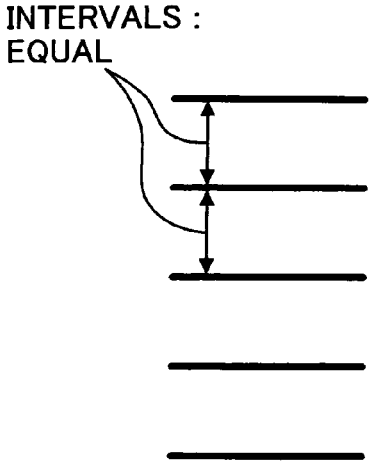
FIG. 2B BACKGROUND ART
FIG. 2B shows an image of lines formed on the photoreceptor.
Figure 2C:
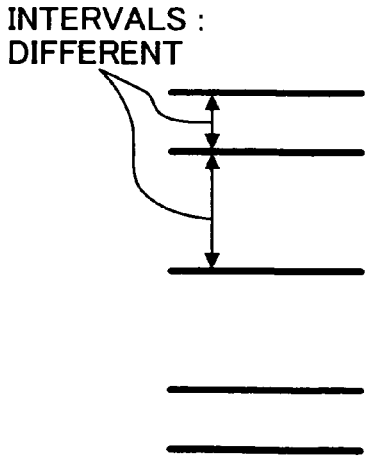
FIG. 2C BACKGROUND ART
FIG. 2C shows an image of lines transferred onto a recording medium from the photoreceptor of the background image forming apparatus.
Figure 3:
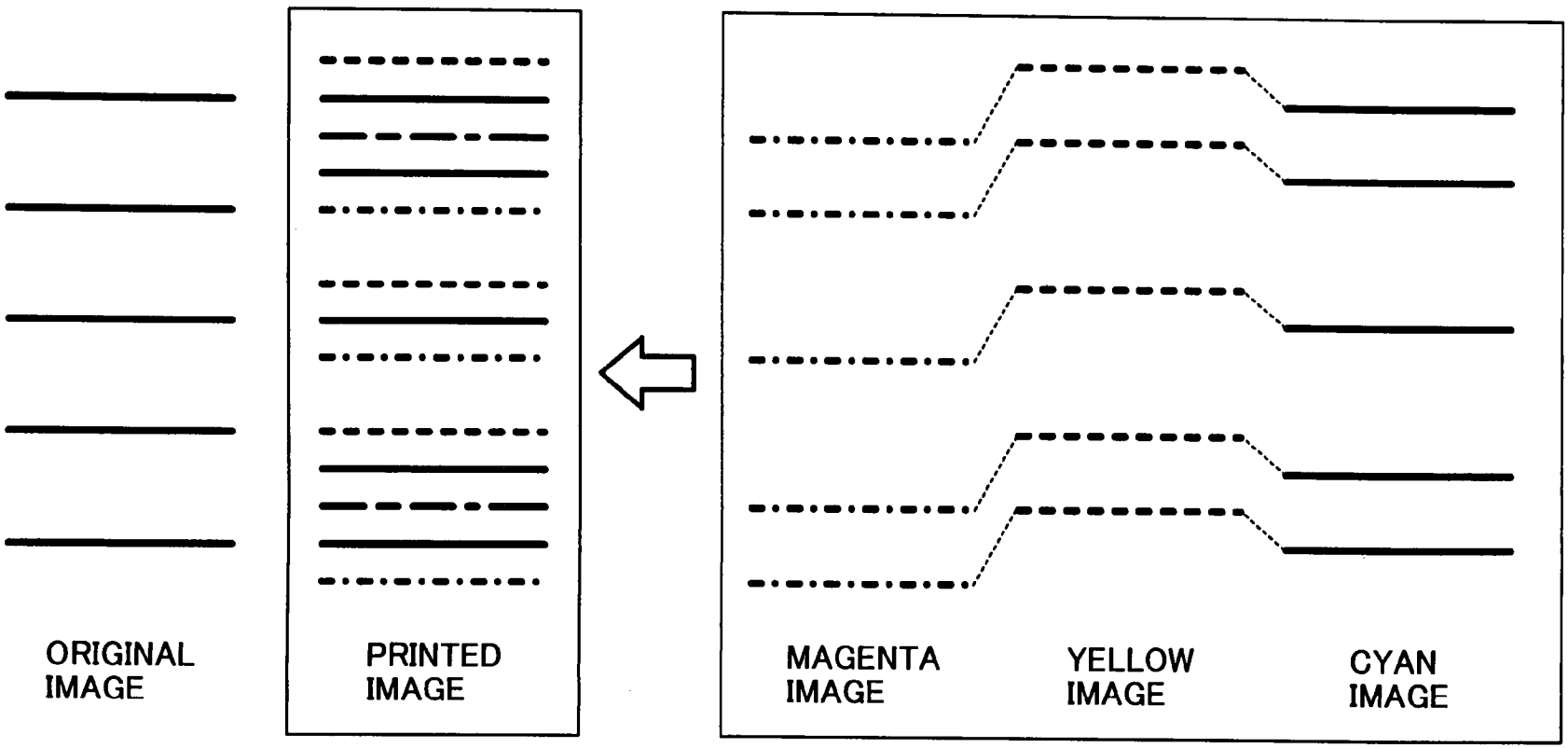
FIG. 3 BACKGROUND ART
FIG. 3 shows images of lines with color shifts caused by the phase shift of each photoreceptor of the background image forming apparatus.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present patent application are described.

Figure 4:
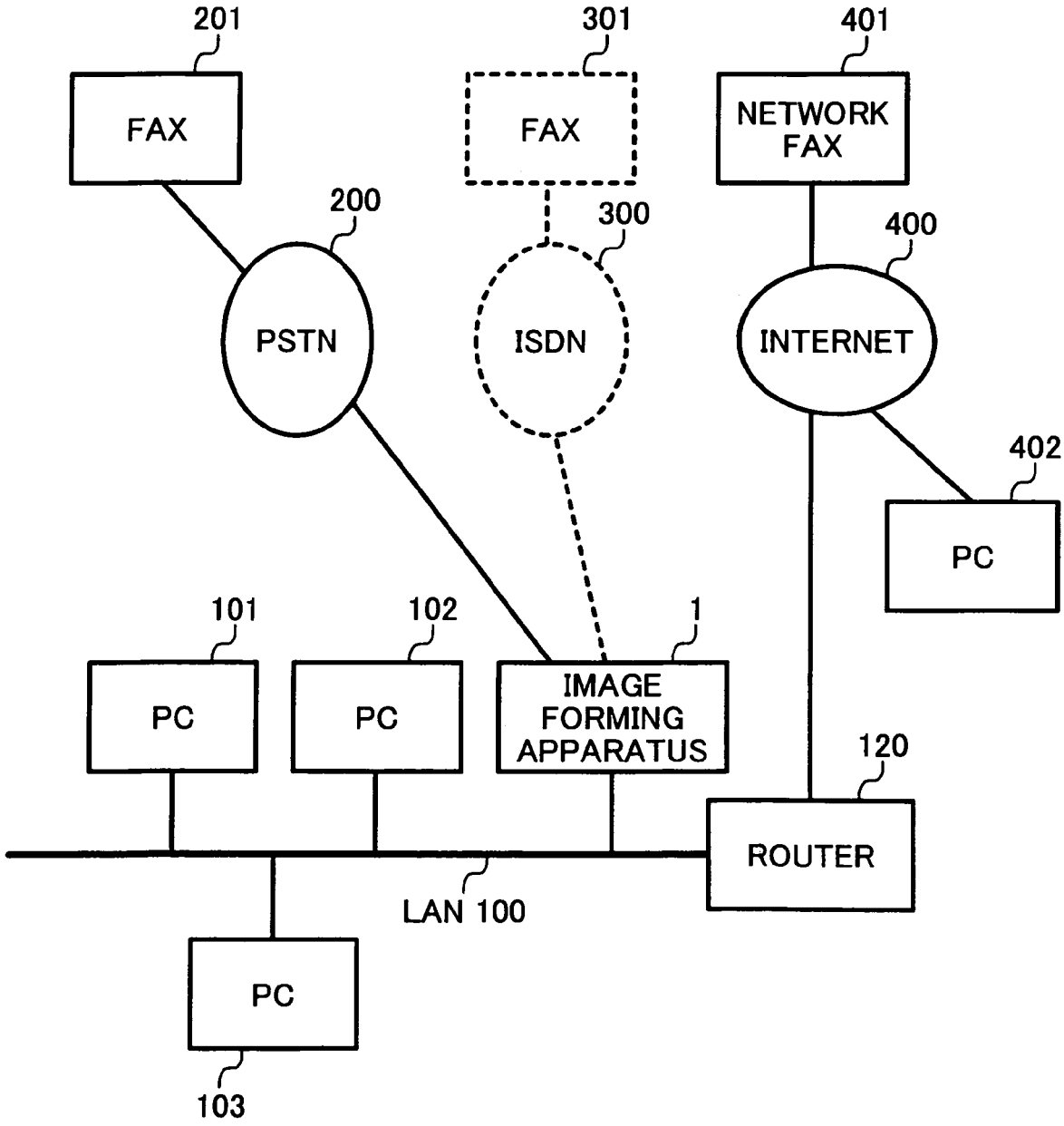
FIG. 4 is a system structure of an image forming apparatus according to an exemplary embodiment of the present invention.

Referring to FIG. 4, a schematic system structure for an image forming apparatus 1 according to an exemplary embodiment of the present invention is described.

In FIG. 4, the image forming apparatus 1 can send and receive image data with a facsimile machine 201 connected with a Public Switched Telephone Network or PSTN 200 via the PSTN 200. With an interface with an Integrated Services Digital Network or ISDN 300, the image forming apparatus 1 can also send and receive image data with a facsimile machine 301 connected with the ISDN 300.

Further, the image forming apparatus 1 can send and receive image data through electronic mail or e-mail with a personal computer or PC 402 via the Internet 400 when the image forming apparatus 1 is connected with the Local Area Network or LAN 100 and with the Internet 400 via a router 120 that performs packet transformations. The image forming apparatus 1 also can send and receive image data through e-mail with a network facsimile machine 401 on the Internet 400 or by real-time network facsimile communications based on the telecom standardization organization of the International Telecommunication Union (ITU-T) recommendation T.38 and so forth.

Furthermore, the image forming apparatus 1 can send and receive image data with personal computers or PCs 101, 102, and 103 on the LAN 100.

The image forming apparatus 1 is a multi-functional apparatus that includes functions as a facsimile machine via a public line, a network facsimile machine, a scanning unit, printer, copier, and so forth for the PCs 101, 102, and 103.

Figure 5:
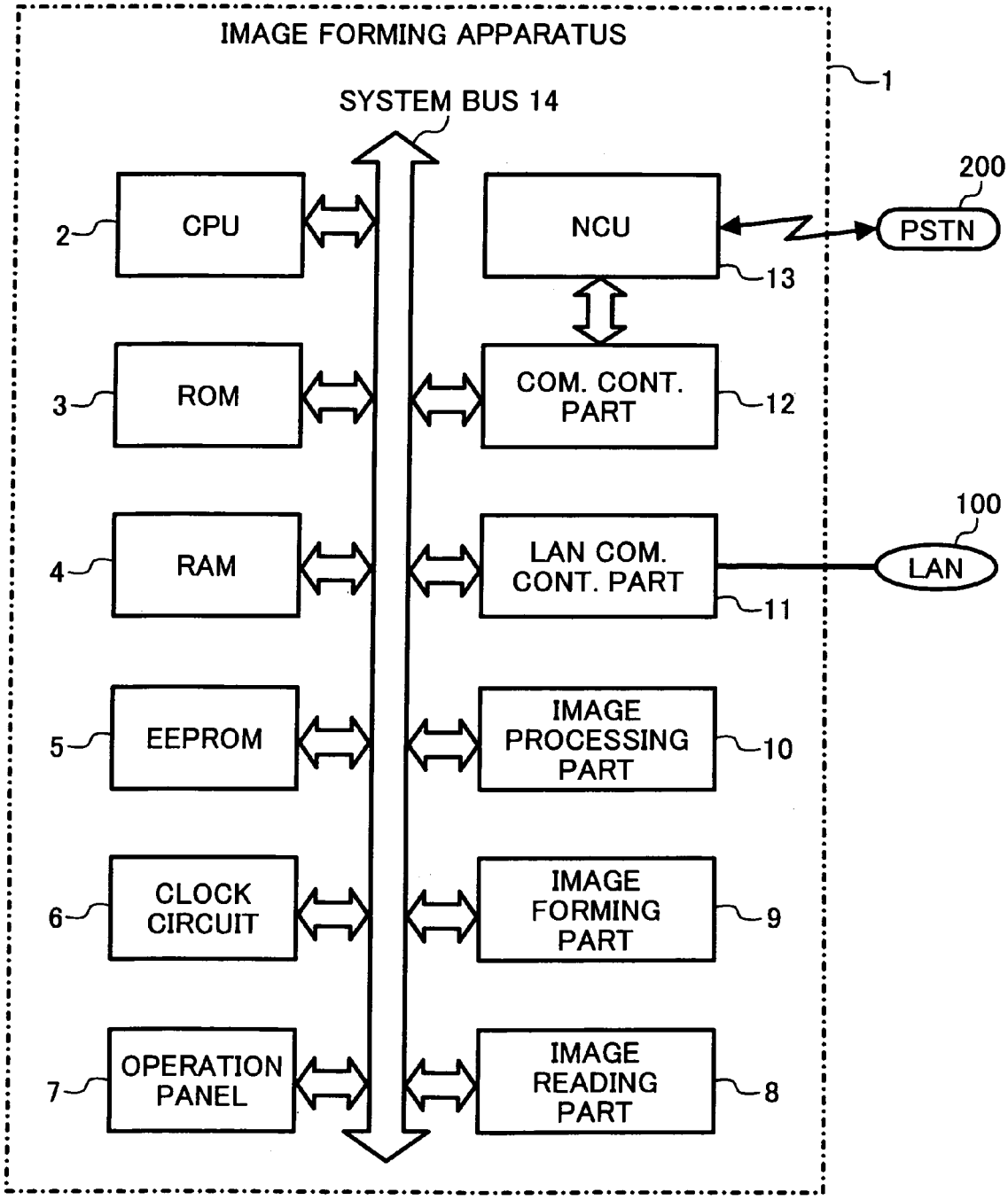
FIG. 5 is a block diagram of the image forming apparatus of FIG. 4.

Referring to FIG. 5, a block diagram of the image forming apparatus 1 is described.

In FIG. 5, the image forming apparatus 1 includes a CPU 2, a ROM 3, a RAM 4, an EEPROM 5, a clock circuit 6, an operation panel 7, an image reading part 8, an image forming part 9, an image processing part 10, a LAN communications controlling part 11, a communications controlling part 12, a network control unit or NCU 13, and a system bus 14.

The CPU 2 is a central processing unit that uses the RAM 4 as its work area, controls each part of the image forming apparatus 1 based on control programs stored in the ROM 3, and performs various data processing and protocol control.

As previously described, the ROM 3 is a read-only memory that stores the control programs for the CPU 2 to control each part of the image forming apparatus 1, and various data required to control, for example, font data corresponding to each character code.

The RAM 4 is a random access memory used as the work area of the CPU 2, as previously described.

The EEPROM 5 is an electrically erasable programmable read-only memory that stores various information required for operations of the image forming apparatus 1 and holds the information even when the power source of the image forming apparatus 1 is turned off. The EEPROM 5 can be replaced by a static RAM or SRAM having a battery backup or a magnetic disk device.

The clock circuit 6 constantly times the current date and time. The CPU 2 reads out the clock circuit 6 via the system bus 14 to obtain the current date and time.

The operation panel 7 has various keys for a user to input data, and a display such as a liquid crystal display instrument to display operation conditions and/or various messages to be informed to the user.

The image reading part 8 reads an original document to obtain image data. The detailed structure of the image reading part 8 will be described later.

The image forming part 9 prints out the image data on a recording medium or a recording sheet. The detailed structure and function of the image forming part 9 will be described later with reference to FIG. 6.

The image processing part 10 performs various processing for the image forming apparatus 1, such as data compression of raw image data by coding, data decompression of the compressed data by decoding, binarizing, variable processing, reduction and enlargement processing, image correction, sorting of order of pixels of image data in each main scanning line, additional processing of additional information such as string information of communication dates, etc.

The LAN communications control part 11 is a so-called Network Interface Card or NIC. The LAN communications control part 11 is connected to the LAN 100 to cause the CPU 2 to use the TCP/IP protocol with the LAN protocol so that information can be exchanged with the upper layer protocol.

The communication control part 12 is connected with the PSTN 200 via the NCU 13, and controls communications between the image forming apparatus 1 and remote apparatuses. The communication control part 12 controls the NCU 13 to detect pulses of ringing voltages detected by the NCU 13, detect DTMF signals and tone signals, and originate a call.

Further, the communication control part 12 includes a modem to demodulate modulated data received from a remote apparatus, and modulate data when sending data. More specifically, the communication control part 12 includes low speed modem functions, V.21 modem, to exchange G3 facsimile machine control signals based on ITU-T recommendation T.30, and high speed modem functions, V.17, V.33, V.34, V.29, V.27ter, to mainly exchange document data.

The Network control unit or NCU 13 is connected with the PSTN 200 to close lines, detect call signals (ringing), and so forth.

The system bus 14 is a set of signal lines including a data bus, address bus, control bus, interrupt signal line, and so forth, to exchange data between the above-described parts.

With the above-described structure, the image forming apparatus 1 serves in multifunctional ways as a printer, a facsimile machine for receiving, a copier, all to print out image data on a recording sheet performed by the image forming part 9 as described above.

Figure 6:
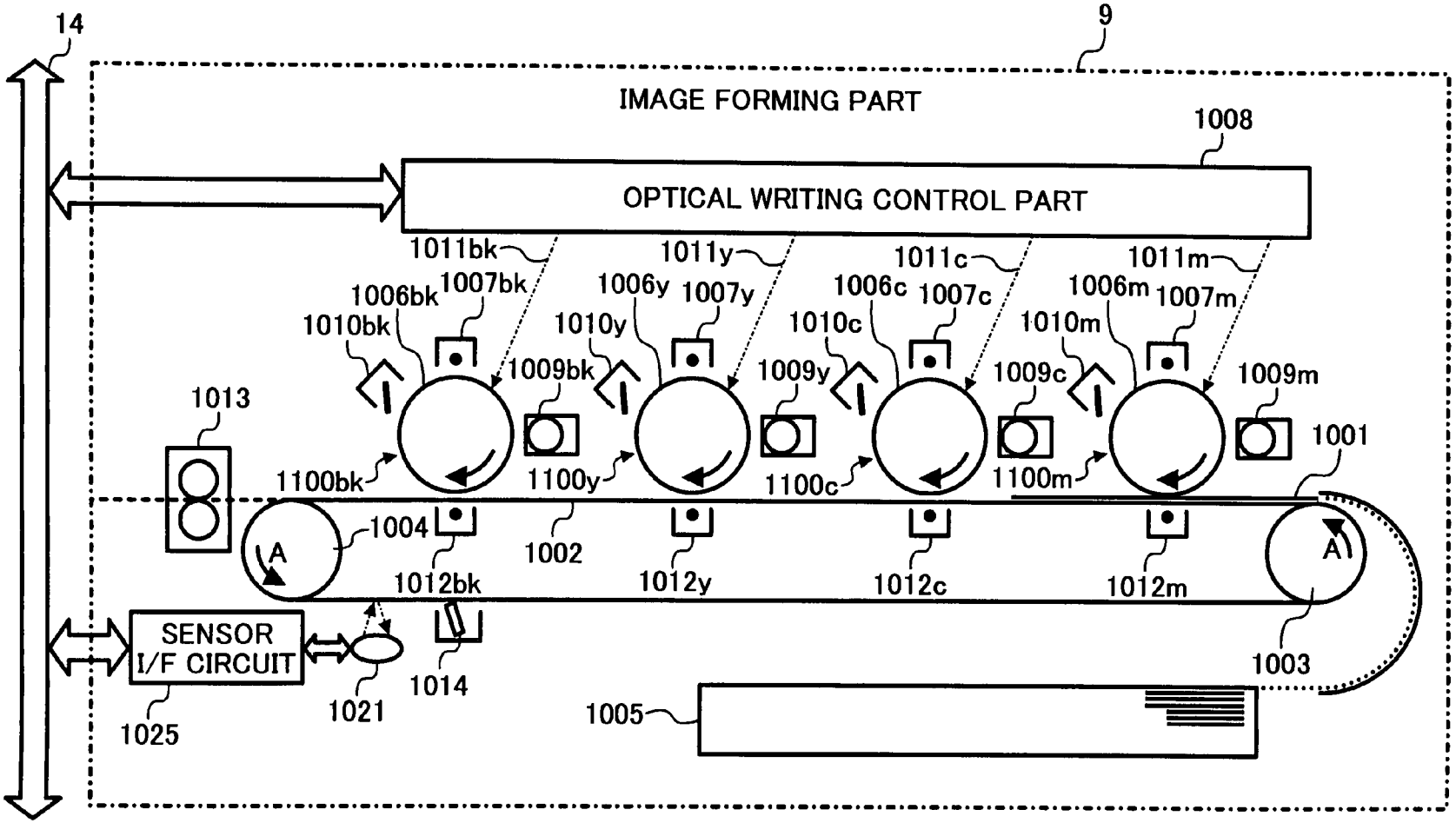
FIG. 6 is a schematic structure of the image forming apparatus of FIG. 4.

Referring to FIG. 6, a schematic structure of the image forming part 9 is described.

The image forming part 9 shown in FIG. 6 is controlled by a controlling unit such as the CPU 2 via the system bus 14 for forming images by using an electrophotographic method. The image forming part 9 employs a tandem-type structure that includes a plurality of image forming mechanisms 1100*m*, 1100*c*, 1100*y*, and 1100*bk* corresponding to each of different color components of toner. The plurality of image forming mechanisms 1100*m*, 1100*c*, 1100*y*, and 1100*bk* include respective photoreceptors 1006*m*, 1006*c*, 1006*y*, and 1006*bk*, a sheet transfer belt 1002, a sheet feeding tray 1005, and an optical writing control part 1008.

The plurality of image forming mechanisms 1100*m*, 1100*c*, 1100*y*, and 1100*bk* are disposed in a horizontal manner along the sheet transfer belt 1002.

The plurality of image forming mechanisms 1100*m*, 1100*c*, 1100*y*, and 1100*bk* corresponding to the plurality of respective color components (magenta: m, cyan: c, yellow: y, black: bk) are disposed in a horizontal manner along the sheet transfer belt 1002, as previously described. The transfer belt 1002 conveys a transfer sheet 1001 serving as a recording medium.

The optical writing control part 1008 emits a laser beam 1011*m* deflected according to a target single color image of a corresponding color component (in this case, magenta) to irradiate the surface of the photoreceptor 1006*m* so that an electrostatic latent image can be formed on the photoreceptor 1006*m*. The optical writing control part 1008 also emits respective laser beams 1011*c*, 1011*y*, and 1011*bk* corresponding to a cyan image, a yellow image, and a black image, accordingly.

The sheet transfer belt 1002 forms an endless belt, and is supported by a drive roller 1003 and a driven roller 1004. The drive roller 1003 drives the sheet transfer belt 1002 to rotate. The driven roller 1004 is rotated following the rotations of the drive roller 1003. The sheet transfer belt 1002 is rotated in a direction as indicated by arrow "A".

The sheet feeding tray 1005 is disposed at a position below the sheet transfer belt 1002 and accommodates a stack of transfer sheets including the transfer sheet 1001. Transfer sheets accommodated in the sheet feeding tray 1005 are sequentially fed by a sheet feeding roller (not shown), starting from a transfer sheet placed at the top of the stack of transfer sheets.

The transfer sheet is conveyed toward the sheet transfer belt 1002, and is electrostatically attracted onto a surface of the sheet transfer belt 1002 as the transfer sheet 1001. The transfer sheet 1001 electrostatically attracted on the sheet transfer belt 1002 is conveyed in a sub-scanning direction of the transfer sheet 1001. While conveyed on the sheet transfer belt 1002, the transfer sheet 1001 reaches one of the image forming mechanisms 1100*m*, 1100*c*, 1100*y*, and 1100*bk* that is located most upstream of the travel direction of the sheet transfer belt 1002. In this case, the image forming mechanism is the image forming mechanism 1100*m* including the photoreceptor 1006*m* corresponding to a color component of magenta, or a color component (m). The photoreceptor 1006*m* is driven to rotate by a photoreceptor drive mechanism (not shown) such that a circumferential speed of the photoreceptor 1006*m* corresponds to a transfer speed of the sheet transfer belt 1002. After the photoreceptor 1006*m*, the transfer sheet 1001 is further conveyed while sequentially passing the image forming mechanism 1100*c* including the photoreceptor 1006*c* corresponding to a color component cyan (c), the image forming mechanism 1100*y* including the photoreceptor 1006*y* corresponding to a color component yellow (y), and the image forming mechanism 1100*bk* including the photoreceptor 1006*bk* corresponding to a color component black (bk).

The image forming mechanism 1100*m* with the photoreceptor 1006*m* further includes a charging unit 1007*m*, a developing unit 1009*m*, and a photoreceptor cleaning unit 1010*m*, which are disposed around the photoreceptor 1006*m*.

The charging unit 1007*m* uniformly charges an outer circumferential surface of the photoreceptor 1006*m*.

The developing unit 1009*m* develops a magenta toner image according to the electrostatic latent image formed on the surface of the photoreceptor 1006*m* by attracting toner of the color component m.

The photoreceptor cleaning unit 1010*m* removes residual toner remaining on the surface of the photoreceptor 1006*m* after the magenta toner image is transferred onto the transfer sheet 1001 conveyed on the sheet transfer belt 1002.

The image forming mechanism 1100*m* further includes a transfer unit 1012*m*. The transfer unit 1012*m* is disposed inside a loop of the sheet transfer belt 1002. The transfer unit 1012*m* is disposed opposite to the photoreceptor 1006*m* while sandwiching the sheet transfer belt 1002. The transfer unit 1012*m* is held in contact with the photoreceptor 1006*m*.

The respective image forming mechanisms 1100*c*, 1100*y*, and 1100*bk* with the photoreceptors 1006*c*, 1006*y*, and 1006*bk* also include respective charging units 1007*c*, 1007*y*, and 1007*bk*, respective developing units 1009*c*, 1009*y*, and 1009*bk*, respective photoreceptor cleaning units 1010*c*, 1010*y*, and 1010*bk*, and respective transfer units 1012*c*, 1012*y*, and 1012*bk*. These components are disposed around the respective photoreceptors 1006*c*, 1006*y*, and 1006*bk*.

The image forming part 9 further includes a fixing unit 1013 and a belt cleaning unit 1014.

The fixing unit 1013 is disposed at a position downstream of the travel direction of the sheet transfer belt 1002, which is in the vicinity of the driven roller 1004 between the photoreceptor 1006*bk* and the belt cleaning unit 1014.

Since the above described components indicated by "m", "c", "y", and "bk" used for image forming operations have similar structures and functions, except that respective toner images formed thereon are of different colors, which are magenta, cyan, yellow, and black toners, the detailed structures and functions of the components disposed around the photoreceptors 1006*c*, 1006*y*, and 1006*bk* are omitted here.

Operations of the image forming mechanism 1100*m* are described below in chronologic order.

The charging unit 1007*m* uniformly charges the surface of the photoreceptor 1006*m*. The optical writing unit 1008 exposes the surface of the photoreceptor 1006*m* by emitting the laser beam 1011*m* deflected according to the image data of the color component m, so as to form an electrostatic latent image on the surface of the photoreceptor 1006*m*. The developing unit 1009*m* develops the electrostatic latent image formed on the photoreceptor 1006*m*. That is, toner contained in the developing unit 1009*m* is attracted to the electrostatic latent image so that a single toner image is formed. When the single toner image reaches a transfer position in which the outer circumference of the photoreceptor 1006*m* contacts the transfer sheet 1001 on the sheet transfer belt 1002, the transfer unit 1012*m* causes the single toner image to be transferred onto the transfer sheet 1001. Subsequently, the single color image (in this case, a magenta image) is formed on the transfer sheet 1001.

After the single toner image is transferred onto the transfer sheet 1001, the photoreceptor cleaning unit 1010*m* removes residual toner remaining on the surface of the photoreceptor 1006*m* so as to prepare for the next image forming operation.

As previously described, the above described components indicated by "m", "c", "y", and "bk" used for image forming operations have similar structures and functions, except that respective toner images formed thereon are of different colors. Therefore, the detailed operations of the components disposed around the photoreceptors 1006*c*, 1006*y*, and 1006*bk* are omitted here.

After the magenta toner image is formed on the transfer sheet 1001 by the image forming mechanism 1100*m*, the transfer sheet 1001 is further conveyed to the image forming mechanisms 1100*c*, 1100*y*, and 1100*bk* so that the cyan, yellow, and black toner images are sequentially transferred thereon so that an overlaid toner image is formed.

After passing the transfer portion formed between the photoreceptor 1006*bk* and the transfer unit 1012 of the last image forming mechanism bk, the transfer sheet 1001 is detached from the sheet transfer belt 1002 so as to be conveyed to the fixing unit 1013.

The fixing unit 1013 fixes the overlaid toner image formed on the transfer sheet 1001 by heat and pressure by using a pair of fixing rollers. Then, the transfer sheet 1001 is discharged out of the image forming part 9.

After the toner images are transferred onto the transfer sheet 1001 and before the next image forming operation begins, the belt cleaning unit 1014 cleans the sheet transfer belt 1002.

The image forming part 9 further includes a marking detection sensor 1021 and a sensor interface (I/F) circuit 1025.

The marking detection sensor 1021 and the sensor I/F circuit 1025 are used to detect and adjust respective phases of the photoreceptors 1006*m*, 1006*c*, 1006*y*, and 1006*bk*. To detect the respective phases of the photoreceptors 1006*m*, 1006*c*, 1006*y*, and 1006*bk*, a predetermined image is printed as a marking. The marking detection sensor 1021 detects the marking, and sends an output of the detection to the sensor I/F circuit 1025. The sensor I/F circuit 1025 sends the result to the CPU 2 via the system bus 14. The CPU 2 determines whether phase adjustment is to be performed, and sends the results to the optical writing control part 1008 so that the optical writing control part 1008 can control each of the photoreceptors 1006*m*, 1006*c*, 1006*y*, and 1006*bk* to adjust their respective phases as needed.

Figure 7:
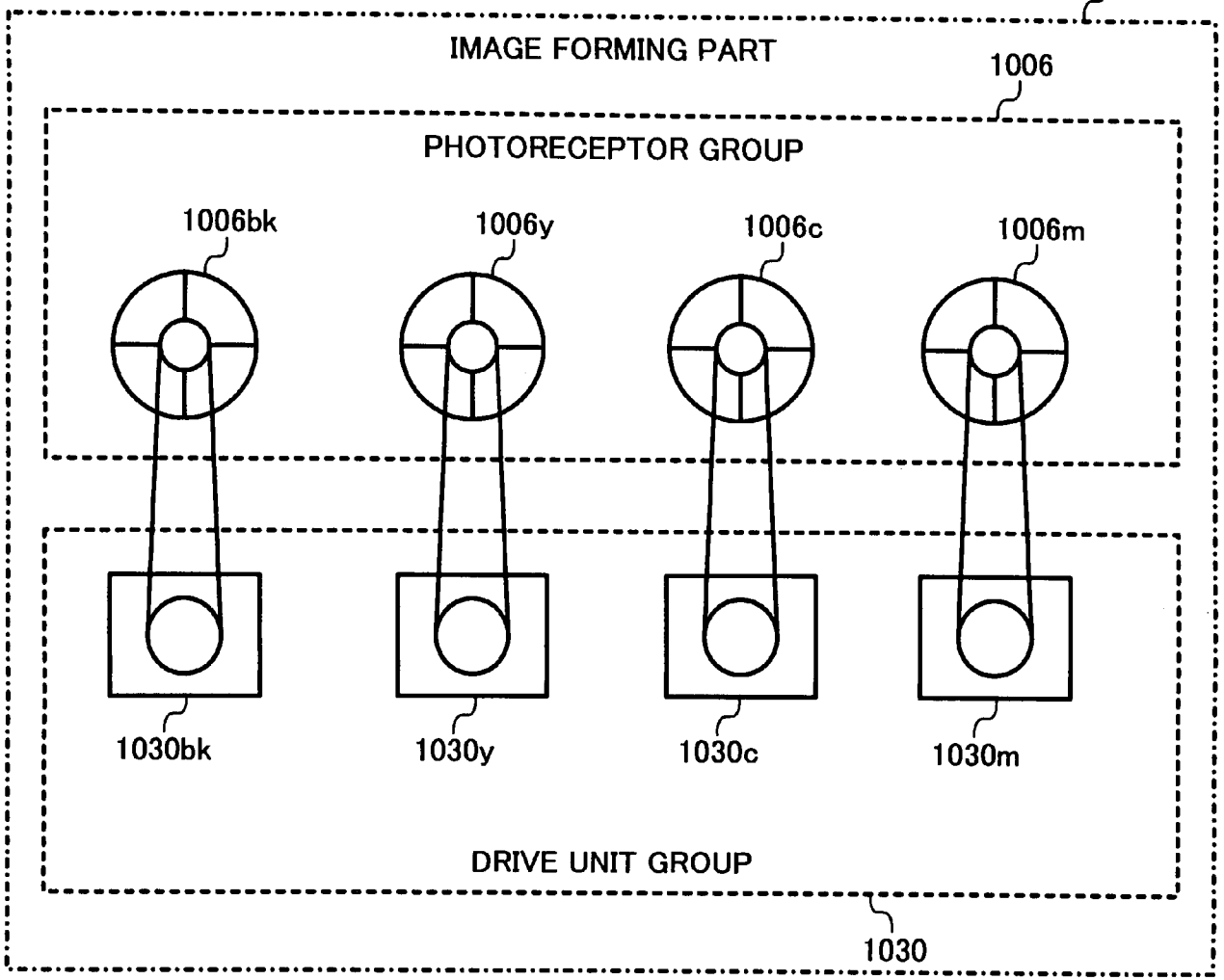
FIG. 7 is a schematic structure of an image forming part of the image forming apparatus of FIG. 6.

Referring to FIG. 7, a schematic structure of a photoreceptor group 1006 and a drive unit group 1030 of the image forming part 9 is described.

In FIG. 7, the photoreceptor group 1006 includes the photoreceptors 1006*m*, 1006*c*, 1006*y*, and 1006*bk*, and the drive unit group 1030 includes drive units 1030*m*, 1030*c*, 1030*y*, and 1030*bk*. The drive units 1030*m*, 1030*c*, 1030*y*, and 1030*bk* of the drive unit group 1030 include motors such as a DC motor, which drive to rotate the photoreceptors 1006*m*, 1006*c*, 1006*y*, and 1006*bk* of the photoreceptor group 1006, respectively.

Further, a phase detecting unit (not shown) is disposed to the photoreceptors 1006*m*, 1006*c*, 1006*y*, and 1006*bk*. The phase detecting unit specifies a measurement start point detected by a photointerruptor and so forth as an origin, and uses a rotary encoder with an incremental method so as to adjust pulses generated with respect to rotation angles of the respective photoreceptor.

The present invention shows a timing of phase detection performed during the rotation of each photoreceptor, and is not limited to a form of phase detection performed during the rotation of each photoreceptor. The present invention may apply widely known mechanisms and methods of phase detection.

Figure 8:
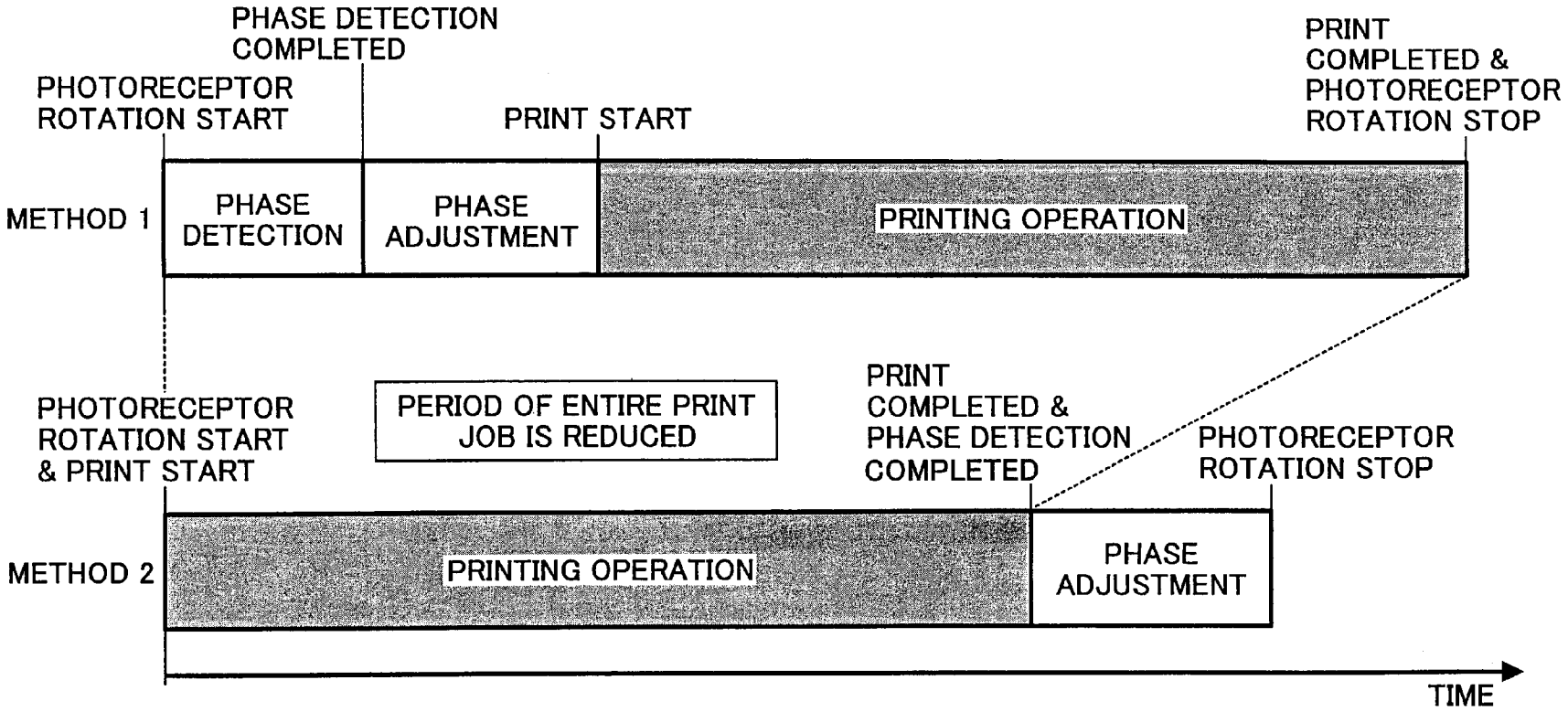
FIG. 8 shows methods of performing image forming operations including phase detection and adjustment operations performed in the image forming apparatus of FIG. 6.

Referring to FIG. 8, two methods of image forming operations, Method 1 and Method 2, including phase detecting and adjusting operations are described.

In FIG. 8, Method 1 shows a form of an image forming operation including a phase detection, a phase adjustment, and a printing operation. In Method 1, the phase detection starts with rotations of the photoreceptors 1006*m*, 1006*c*, 1006*y*, and 1006*bk*, the phase adjustment follows the phase detection, and thereafter the printing operation is performed. More specifically, when a user issues a print start request, the photoreceptors 1006*m*, 1006*c*, 1006*y*, and 1006*bk* start rotating to detect their respective phases. When the phase detection is completed, the phase adjusting is then started. After the phase adjusting is completed, the printing operation is finally started. When the printing operation is finished, a printed copy is output and the photoreceptors stop rotating.

Method 2 shows an example operation according to the present invention. In Method 2, the phase detection is performed during the printing operation so that phases of respective photoreceptors 1006*m*, 1006*c*, 1006*y*, and 1006*bk* can be detected while the respective photoreceptors 1006*m*, 1006*c*, 1006*y*, and 1006*bk* are rotating. More specifically, when a user issues a print start request, the image forming apparatus 1 starts the printing operation and, at the same time, causes the photoreceptors 1006*m*, 1006*c*, 1006*y*, and 1006*bk* to rotate. That is, the phase detection is performed during the printing operation. When the printing operation is finished, the phase detection is also completed. Based on the result of the above-described phase detection, the phase adjustment is performed while the photoreceptors are still rotating after the printing operation so that the stop timings of the respective photoreceptors can be adjusted so that the photoreceptors are stopped at appropriate phase adjusted positions. After the phase adjustment is completed, the photoreceptors stop rotating. By performing the above-described operations of Method 2, the phases of the respective photoreceptors can be controlled to become predetermined phase relationships.

With the above-described operations, the respective photoreceptors 1006*m*, 1006*c*, 1006*y*, and 1006*bk* can be adjusted to respective desired phases after the printing operation, and thereby the image forming apparatus 1 can instantly start the next printing operation. That is, when a user issues a print start request, the printing operation can be started without delay before the start of the printing operation because the photoreceptors were stopped at proper phase adjusted positions. Therefore, the waiting time that is a period of time used for the phase detection and adjustment can be reduced and the user can obtain a desired printout more quickly when compared with Method 1.

Figure 9:
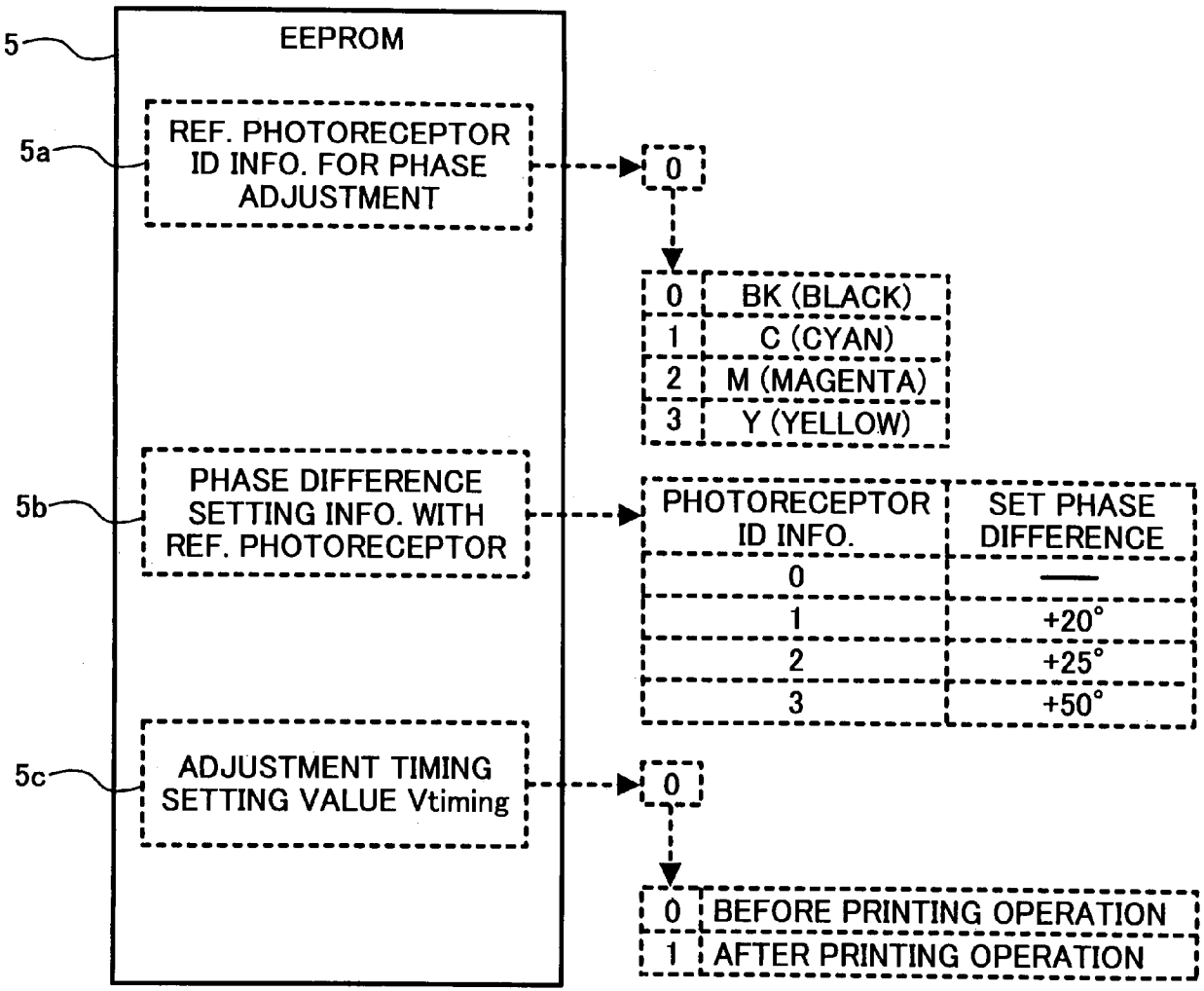
FIG. 9 shows storage areas of an EEPROM of the image forming apparatus of FIG. 6.

Referring to FIG. 9, a schematic structure of the EEPROM 5 of the image forming apparatus 1 is described.

In FIG. 9, the EEPROM 5 stores "reference photoreceptor identification information for phase adjustment" in a storage area 5*a*, "phase difference setting information with reference photoreceptor" in a storage area 5*b*, and "adjustment timing setting value Vtiming" in a storage area 5*c*.

In FIG. 9, "Reference photoreceptor identification information for phase adjustment" stored in the storage area 5*a* of the EEPROM 5 shows the current setting value is set to "0" for black.

"Reference photoreceptor identification information for phase adjustment" stored in the storage area 5*a* is information to specify a photoreceptor as a reference photoreceptor for phase adjustment and to store a value related to the reference photoreceptor when the value is set or changed. The value is set to one of "0" for "bk (black)", "1" for "c (cyan)", "2" "m (magenta)", and "3" for "y (yellow)".

"Phase difference setting information with reference photoreceptor" stored in the storage area 5*b* in FIG. 9 is information to specify respective phase differences of respective non-reference photoreceptors with respect to the reference photoreceptor for phase adjustment specified in the storage area 5*a*, and to store a value related to the phase difference of each non-reference photoreceptor when the value is set or changed. The non-reference photoreceptors are the respective photoreceptors other than the reference photoreceptor. The respective phase differences of the photoreceptors are set to the same values as defined in "reference photoreceptor identification information for phase adjustment" in the storage area 5*a*.

More specifically, the photoreceptor of Value "0" for BK is currently specified as a reference photoreceptor in the storage area 5*a*. Therefore, there is no need to specify its phase difference.

The photoreceptor of Value "1" for C is set to "+20 degree", indicating that the photoreceptor has the phase difference by 20 degree of angle. The photoreceptor of Value "2" for M is set to "+25 degree", indicating that the photoreceptor has the phase difference by 25 degree of angle. The photoreceptor of Value "3" for Y is set to "+50 degree", indicating that the photoreceptor has the phase difference by 50 degree of angle.

For "adjustment timing setting value Vtiming" stored in the storage area 5*c*, Value "0" indicates that the phase detection and adjustment are performed before the start of the printing operation or "Before printing operation", and Value "1" indicates that the phase detection and adjustment are performed after the completion of the printing operation or "After printing operation". "Adjustment timing setting value Vtiming" of FIG. 9 shows that the current value is set to "0". "Before printing operation" means that the phase detection and adjustment are performed using Method 1 of FIG. 8, and "After printing operation" means that the phase detection and adjustment are performed using Method 2 of FIG. 8.

The significance of specifying "reference photoreceptor identification information for phase adjustment" in the storage area 5*a* is now described.

In color image forming apparatuses with a plurality of photoreceptors, some replace the plurality of photoreceptors all together at one time, but some replace them separately. In a case in which the color image forming apparatus separately replacing the photoreceptors replaces a reference photoreceptor, if a new reference photoreceptor is out of phase, the new reference photoreceptor may change the other photoreceptors to be out of phase even when the other photoreceptors are previously adjusted to proper phases.

To avoid the above-described circumstance, "reference photoreceptor identification information for phase adjustment" in the storage area 5*a* can effectively be used. A user can select and change a reference photoreceptor for phase adjustment by setting a value in "reference photoreceptor identification information for phase adjustment" in the storage area 5*a*. For example, a user can change a reference photoreceptor from a currently selected photoreceptor to be replaced to a different photoreceptor. With the above-described operation, a period of time for phase adjustment can be reduced.

Next, significance of specifying "phase difference setting information with reference photoreceptor" in the storage area 5*b* is described.

When the image forming apparatus 1 includes the plurality of photoreceptors 1006*m*, 1006*c*, 1006*y*, and 1006*bk*, the plurality of photoreceptors 1006*m*, 1006*c*, 1006*y*, and 1006*bk* may rotate in an off-centered or eccentric manner, which results in a problem that the sheet transfer belt 1002 receives a vibration or shock by being hit by the plurality of photoreceptors 1006*m*, 1006*c*, 1006*y*, and 1006*bk*.

For example, when the plurality of photoreceptors 1006*m*, 1006*c*, 1006*y*, and 1006*bk* have identical degree and position of eccentricity and timing to hit the sheet transfer belt 1002, vibration or shock may simultaneously be given onto the sheet transfer belt 1002.

When the plurality of photoreceptors 1006*m*, 1006*c*, 1006*y*, and 1006*bk* have different phases of eccentricity from each other, a first photoreceptor, for example the photoreceptor 1006*m*, may hit the surface of the sheet transfer belt 1002 and thereafter the photoreceptor 1006*c* disposed adjacent to the photoreceptor 1006*m* may hit the same portion of the surface of the sheet transfer belt 1002. In this case, there is a possibility that an amount of deviation of respective phases of the photoreceptors 1006*m* and 1006*c* is equal to the distance between the photoreceptors 1006*m* and 1006*c*.

When the plurality of photoreceptors 1006*m*, 1006*c*, 1006*y*, and 1006*bk* have respective degrees and positions of eccentricity and respective timings from each other to hit the sheet transfer belt 1002, vibration or shock exerted by the plurality of photoreceptors 1006*m*, 1006*c*, 1006*y*, and 1006*bk* may be given onto the sheet transfer belt 1002 at different timings, which can make the surface of the sheet transfer belt 1002 wavy.

The conditions of causing vibration or shock to the sheet transfer belt 1002 may vary depending on the structural conditions of products. However, vibration or shock can be a cause of deterioration of the sheet transfer belt 1002.

To avoid the above-described circumstance, a user can select a photoreceptor performing as a reference photoreceptor for phase adjustment and phase differences between the reference photoreceptor and the other respective photoreceptors, which are hereinafter referred to as "non-reference photoreceptors". This can mitigate vibration or shock with respect to the sheet transfer belt 1002 by individual products, obtain higher quality in printing, and extend a life of each of the sheet transfer belt 1002 and the photoreceptors 1006*m*, 1006*c*, 1006*y*, and 1006*bk*.

Next, the significance of specifying "adjustment timing setting value Vtiming" in the storage area 5*c* is described.

Even when the phase of a photoreceptor is adjusted after a printing or image forming operation is finished, there is a possibility that the photoreceptor becomes out of phase before the following printing operation is started. This out-of-phase condition of the photoreceptor may be caused when the phase adjustment has not properly been performed or when the phase of the photoreceptor is changed during a period from the previous phase adjustment to the start of the next printing operation.

More specifically, a photoreceptor driven by a DC motor having a small retentive power can easily be out of phase. Even when the phase of the photoreceptor is adjusted after a printing operation, the photoreceptor can be out of phase by making an impact on the phase-adjusted photoreceptor when a user or operator collides against the image forming apparatus 1 or when the image forming apparatus 1 is moved.

Further, when the photoreceptor is replaced before the printing operation, the respective photoreceptors 1006*m*, 1006*c*, 1006*y*, and 1006*bk* in the image forming apparatus 1 are not adjusted to respective proper phases.

To avoid possible color shift on a printout produced under the above-described circumstance, it is preferable that the phase adjustment is performed before the start of a printing operation.

Therefore, a value of "adjustment timing setting value Vtiming" stored in the storage area 5*c* is preferably set. Setting a value of "adjustment timing setting value Vtiming" can allow a user to select a timing of performing the phase adjustment at each printing operation. That is, a user can select whether the phase adjustment is performed before or after a printing operation.

With this setting, the user can double check the phases of the photoreceptors 1006*m*, 1006*c*, 1006*y*, and 1006*bk* when the user is not sure whether the phases are properly adjusted or not. For example, it is assumed that the phase adjustment was performed after the previous printing operation. However, when it is likely that the phases of the photoreceptors 1006*m*, 1006*c*, 1006*y*, and 1006*bk* became out of phase, the user can set the timing of performing the phase adjustment to "Before printing operation" so that the phase adjustment can be performed once again before the next printing operation.

Figure 10:
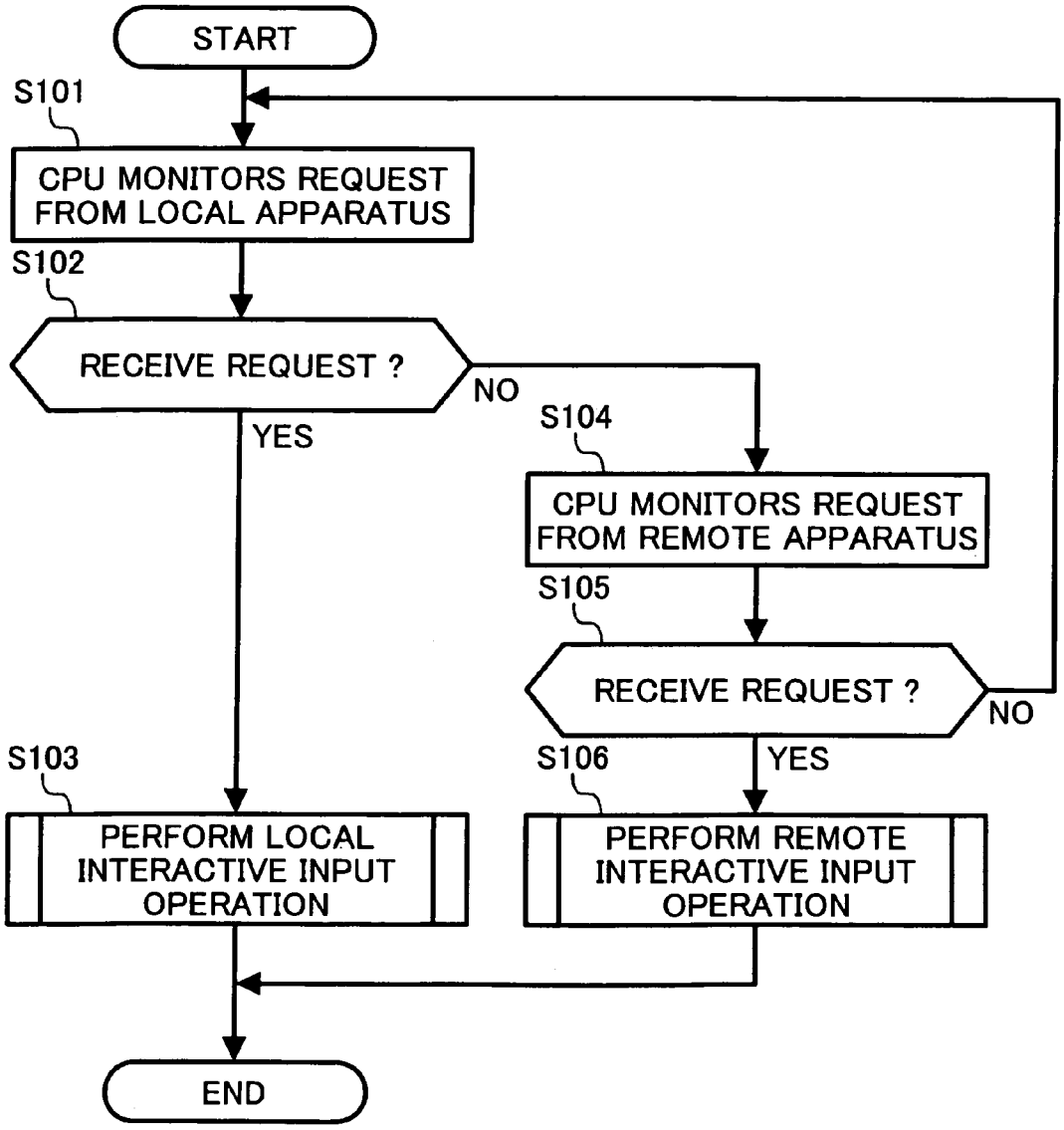
FIG. 10 is a flowchart of a procedure for setting a phase adjustment in the image forming apparatus of FIG. 6.

Referring to FIG. 10, a flowchart of a procedure for setting the phase adjustment in the image forming apparatus 1 is described.

In step S101 of FIG. 10, the CPU 2 monitors whether or not a user inputs a request to move to a phase adjustment setting mode, by performing a predetermined input operation from the operation panel 7 of a local apparatus, which is the image forming apparatus 1, and the process moves to step S102.

In step S102, when the CPU 2 receives the request from the local apparatus through the operation panel 7, the process goes to step S103. When the CPU 2 does not receive the request from the local apparatus through the operation panel 7 in step S102, the process goes to step S104.

In step S103, the CPU 2 performs a local interactive input operation, and the procedure is completed.

In step S104, the CPU 2 monitors whether or not the local apparatus receives, through the LAN communications control part 11, the request to move to the phase adjustment setting mode, from a remote apparatus via the network, for example the LAN 100, the Internet 400, etc., and the process goes to step S105.

In step S105, when the CPU 2 receives the request from the remote apparatus through the LAN communications control part 11, the process goes to step S106. When the CPU 2 does not receive the request from the remote apparatus through the LAN communications control part 11 in step S105, the procedure goes back to step S101 to repeat the process.

In step S106, the CPU 2 performs a remote interactive input operation, and the procedure is completed.

In the local interactive input operation in step S103, information of respective values of "reference photoreceptor identification information for phase adjustment", "phase difference setting information with reference photoreceptor", and "adjustment timing setting value Vtiming" are set and stored in the storage areas 5*a*, 5*b*, and 5*c*, respectively, in an interactive manner via the operation panel 7.

In the remote interactive input operation in step S105, information of respective values of "reference photoreceptor identification information for phase adjustment", "phase difference setting information with reference photoreceptor", and "adjustment timing setting value Vtiming" are set and stored in the storage areas 5*a*, 5*b*, and 5*c*, respectively, in an interactive manner by communicating with the remote apparatus, for example from the PC 101 shown in FIG. 4 through the LAN communications control part 11.

Thus, a user can set and store the values shown in FIG. 9 from the local apparatus directly or from the remote apparatus via the network so that the image forming apparatus 1 can perform phase detecting and adjusting operations under preferable conditions.

The interface between the remote apparatus and the image forming apparatus 1 is not limited to a general network such as the LAN 100 or the Internet 400. As an alternative, a general-purpose interface such as USB, IEEE1394, which are used for personal computers, can be applied to the interface between the local and remote apparatuses.

Further, the interface between the local and remote apparatuses can be private lines, exclusive lines, or an IP network that can be used for exchanging commands and responses between the remote and local apparatuses.

Further, the remote apparatus is not limited to personal computers. In this embodiment, the remote apparatus can be other image forming apparatuses.

Figure 11:
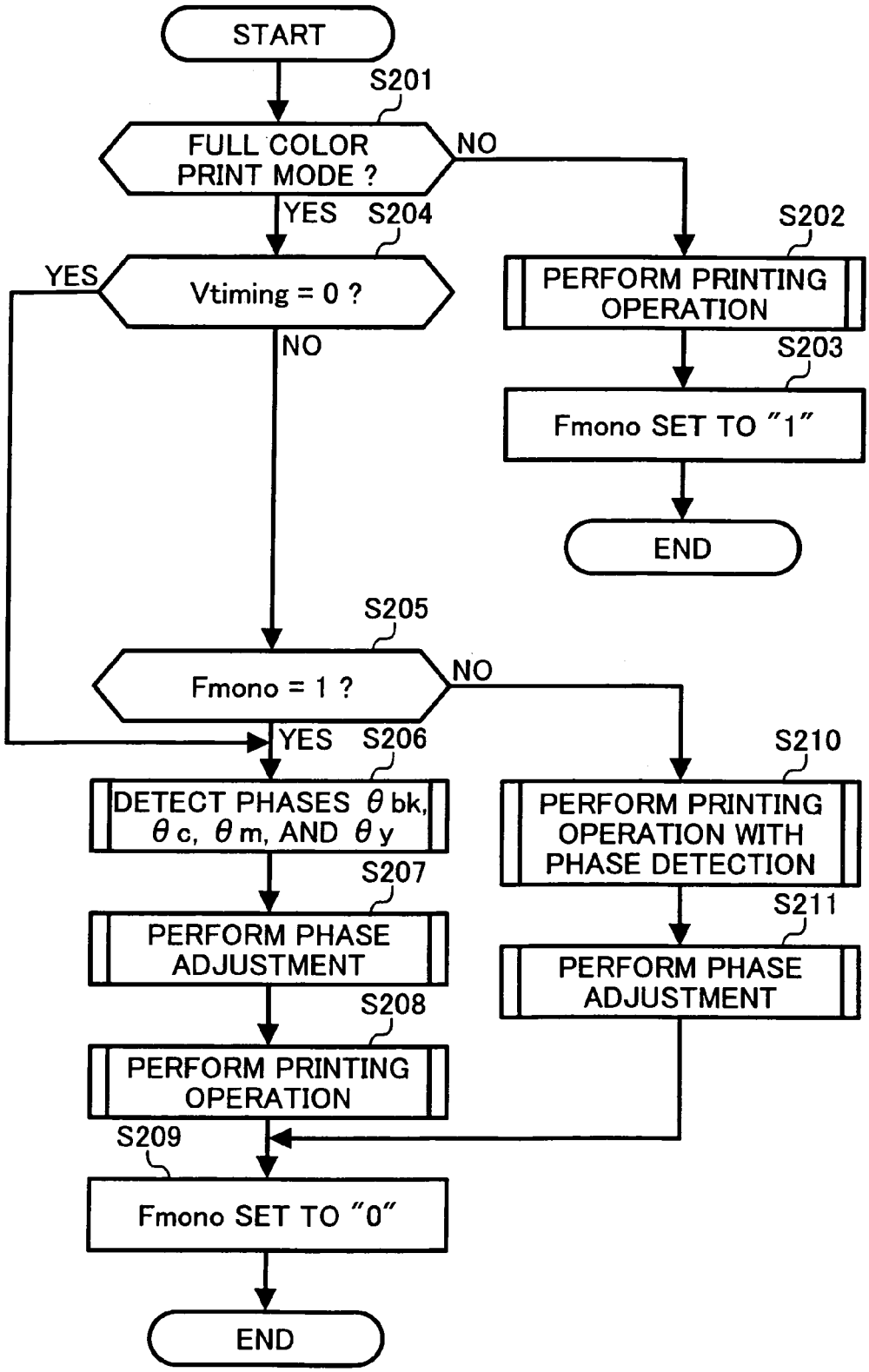
FIG. 11 is a flowchart of a procedure for controlling the image forming operation in the image forming apparatus of FIG. 6.

Referring to FIG. 11, a flowchart of a procedure for controlling the image forming operation or the printing operation in the image forming apparatus 1 is described.

In step S201 of FIG. 11, the CPU 2 determines whether a print mode for the previous printing operation is a "full color print mode" in which all the photoreceptors 1006*m*, 1006*c*, 1006*y*, and 1006*bk* are used or a "mono color print mode" in which one of the photoreceptors 1006*m*, 1006*c*, 1006*y*, and 1006*bk* is used.

When the print mode is the "full color print mode", the result of step S201 is YES, and the process goes to step S204. When the print mode is the "mono color print mode", the result of step S201 is NO, and the process goes to step S202.

In step S202, the CPU 2 causes a drive unit corresponding to the specified photoreceptor to rotate the specified photoreceptor so that the printing operation in the "mono color mode" is performed, and the process goes to step S203.

In step S203, the CPU 2 set a flag variable "Fmono", which is stored in the RAM 3, to Value "1", and the procedure is completed.

Performing the printing operation in the "mono color print mode" in which a photoreceptor corresponding to one color component is used releases the adjustment of respective phase differences of photoreceptors. Therefore, Value "1" of the flag variable "Fmono" indicates that the phase of the photoreceptor is not properly adjusted.

In step S204, the CPU 2 determines whether "adjustment timing setting value Vtiming" stored in the storage area 5*c* of FIG. 9 is set to Value "0" or not.

When the Vtiming is not set to Value "0", the result of step S204 is NO, and the process goes to step S205.

When the Vtiming is set to Value "0", the result of step S204 is YES, and the process goes to step S206.

In step S205, the CPU 2 determines whether the value of "Fmono" is set to "1" or not. This step is to determine whether or not there is any photoreceptor that did not rotate in the previous printing operation, which prevented the phase adjustment from being performed.

When the value of "Fmono" is set to "1", the result of step S205 is YES, and the process goes to step S206.

When the value of "Fmono" is set to "0", the result of step S205 is NO, and the process goes to step S210.

In step S210, since the phases of the respective photoreceptors have been adjusted, the CPU 2 performs the phase detection while performing the printing operation, as shown in Method 2 of FIG. 4, and the process goes to step S211.

In step S211, the CPU 2 adjusts the phases of the respective photoreceptors at the completion of the printing operation while the respective photoreceptors are still rotating, and the process goes to step S209.

In step S209, the CPU 2 sets the value of "Fmono" to "0", and the procedure is completed.

In step S206, since the phase detection and adjustment are performed prior to the start of the printing operation, the CPU 2 detects phases θbk, θc, θm, and θy corresponding to the photoreceptors 106*c*, 106*m*, 106*y*, and 106*bk*, respectively, and the process goes to step S207.

In step S207, the CPU 2 performs the phase adjustment by increasing or decreasing rotational speeds of the respective photoreceptors so that the detected phases of the respective photoreceptors meet the conditions of "phase difference setting information with reference photoreceptor" stored in the storage area 5*b* of FIG. 9, and the process goes to step S208.

In step S208, the CPU 2 performs the printing operation, and the process goes to step S209.

As previously described, in step S209, the CPU 2 sets the value of "Fmono" to "0", and the procedure is completed.

When the user selects the "mono color print mode" for a single color printing including a black and white printing, not all the photoreceptors in the image forming apparatus 1 may be used.

In the flowchart of FIG. 11, the photoreceptor used for the printing operation is out of phase after steps S202 and S203, with respect to the other photoreceptors not used for the printing operation. In this case, even if the user has already performed the phase adjustment after the printing operation, it is preferable that the phases of the photoreceptors are adjusted one more time before starting the following printing operation.

Accordingly, after the mono color printing operation is performed, another phase adjustment is performed before the following printing operation regardless of the setting previously made by the user.

Thus, Method 2 shown in FIG. 8 can reduce a period of time before starting the printing operation, and can further reduce a load on the user by automatically performing the phase adjustment, regardless of the setting made by the user, before the following printing operation when the mono color printing operation is performed.

Figure 12:
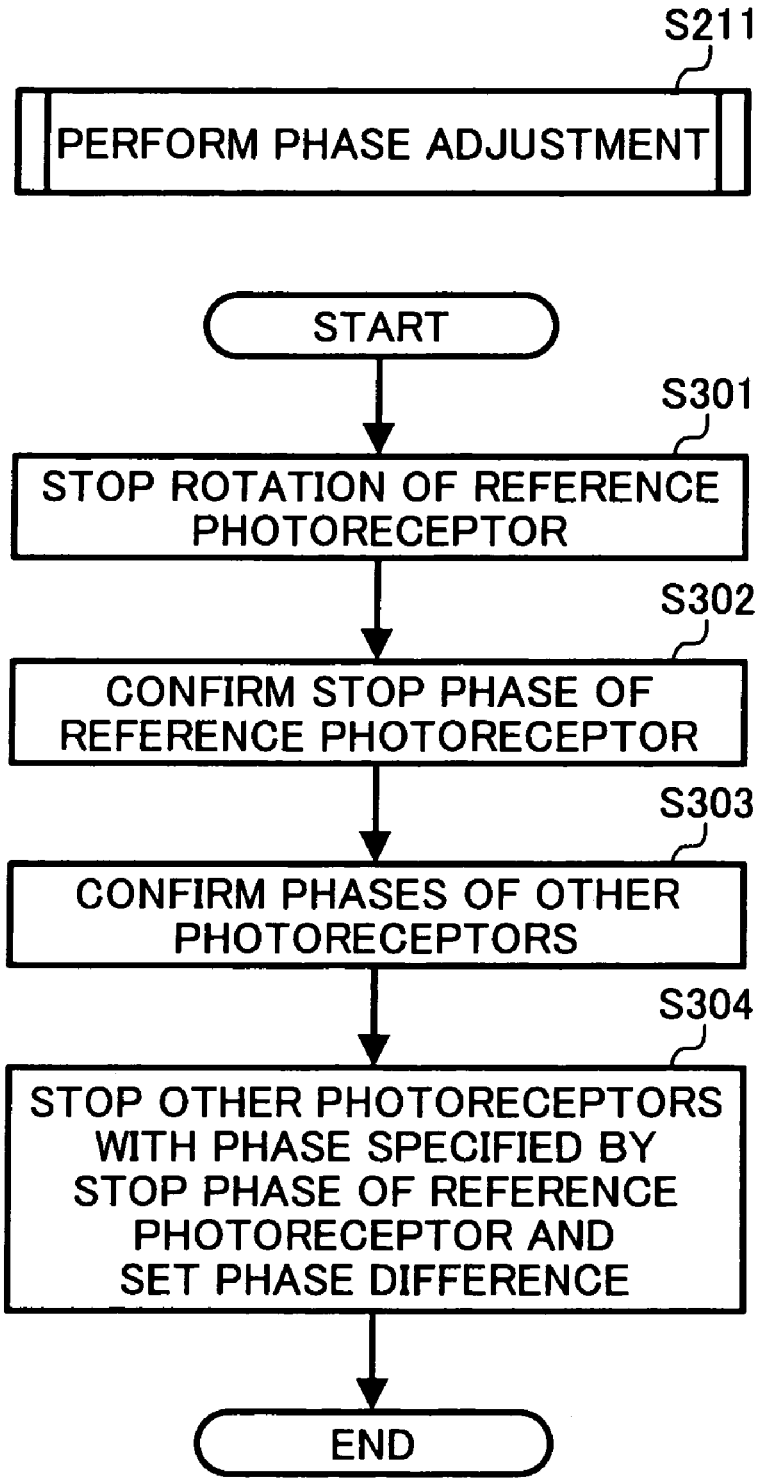
FIG. 12 is a flowchart of a detailed procedure for phase adjustment performed in the flowchart of FIG. 11.

Referring to FIG. 12, a flowchart of a detailed procedure for the phase adjustment of S211 in the flowchart of FIG. 11 is described.

In step S301 of FIG. 12, the CPU 2 causes a drive unit corresponding to the reference photoreceptor, stored in the storage area 5*a* of FIG. 9, to stop so that the reference photoreceptor stops its rotation, and the process goes to step S302.

In step S302, the CPU 2 confirms the stop phase of the reference photoreceptor, and the process goes to step S303.

In step S303, the CPU 2 confirms the phases of the photoreceptors other than the reference photoreceptor that are still rotating after the printing operation of step S210 of FIG. 11, and the process goes to step S304.

In step S304, the CPU 2 decreases the rotation speed of the respective photoreceptors to stop so that the phases of the respective non-reference photoreceptors confirmed in step S303 stop with the respective phases specified according to the stop phase of the reference photoreceptor confirmed in step S302 and the set phase difference stored in the storage area 5*b*, and the procedure is completed.

With the procedure of FIG. 12, the photoreceptors including the reference photoreceptor can be adjusted to the respective phase differences specified in the storage area 5*b* of FIG. 9. Accordingly, any further phase detection and adjustment are not performed before the following printing operation performed in step S210, and thereby the period of time for the printing operation, from a user's point of view, can be reduced.

Figure 13:
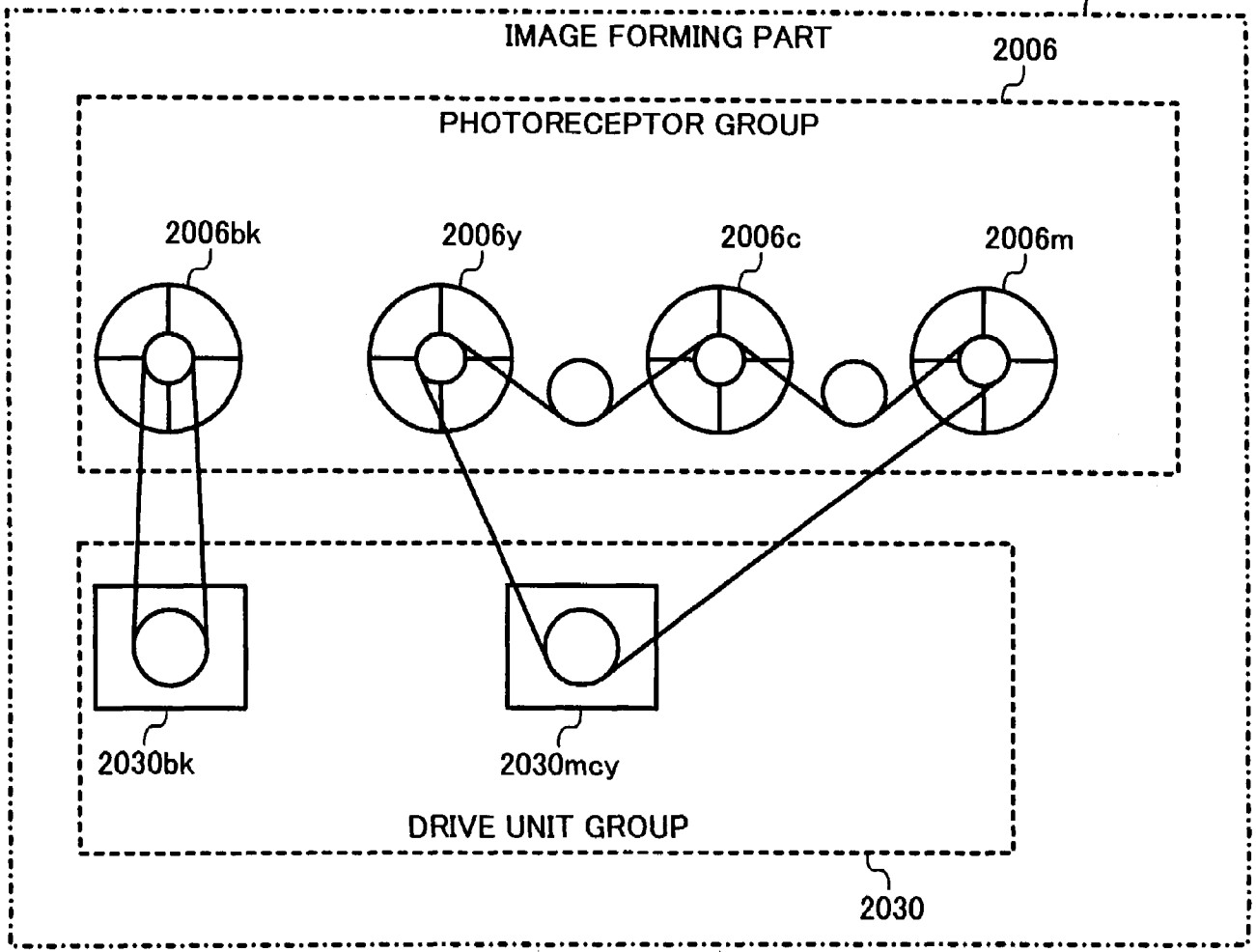
FIG. 13 is a schematic structure of the image forming part according to another exemplary embodiment of the present invention.

Referring to FIG. 13, a schematic structure of the image forming part 9 according to another exemplary embodiment of the present invention is described.

In FIG. 13, the image forming part 9 includes a photoreceptor group 2006 including photoreceptors 2006*m*, 2006*c*, 2006*y*, and 2006*bk*, and a drive unit group 2030 including drive units 2030*bk* and 2030*mcy*. In this structure, the drive unit 2030*mcy* drives the photoreceptors 2006*m*, 2006*c*, and 2006*y* in conjunction with each other. The above-described operations in the present invention can be applied to the structure of FIG. 13.

More specifically, the phase detection and adjustment operations of the present invention can be performed with respect to the three photoreceptors 2006*c*, 2006*m*, and 2006*y* driven in conjunction with each other by the drive unit 2030*mcy* by regarding the three photoreceptors 2006*c*, 2006*m*, and 2006*y* as one photoreceptor to be adjusted.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. An image forming apparatus, comprising:

a plurality of photoreceptors configured to bear respective images on respective surfaces thereof;

a phase detecting unit configured to perform a phase detection so as to detect respective phases of the plurality of photoreceptors;

a phase adjusting unit configured to perform a phase adjustment so as to adjust the respective phases of the plurality of photoreceptors to become in predetermined correlated phase relationships, based on an output from the phase detecting unit; and a control unit configured to specify a first form of an image forming operation in which the phase detecting unit performs the phase detection during a printing operation, and the phase adjusting unit performs the phase adjustment while the plurality of photoreceptors are rotating after a completion of the printing operation so that the plurality of photoreceptors are stopped in the predetermined correlated phase relationships.

2. The image forming apparatus according to claim 1, wherein the control unit is further configured to specify a second form of an image forming operation in which the phase detecting unit performs the phase detection prior to a start of the printing operation, the phase adjusting unit performs the phase adjustment so that the respective phases of the plurality of photoreceptors become the predetermined correlated phase relationships, and the printing operation is started after the phase adjustment.

3. The image forming apparatus according to claim 2, wherein the control unit is configured to select one of the first and second forms of image forming operations in accordance with a setting input to the control unit.

4. The image forming apparatus according to claim 3, wherein the second form of image forming operation is selected regardless of the setting of the control unit in a case in which at least one of the plurality of photoreceptors is not rotated in the printing operation and the at least one of the plurality of photoreceptors is rotated in the following printing operation.

5. The image forming apparatus according to claim 1, further comprising:

a plurality of photoreceptor drive units configured to drive the plurality of photoreceptors, wherein one of the plurality of photoreceptor drive units drives two or more photoreceptors of the plurality of photoreceptors in conjunction with each other, the two or more photoreceptors being regarded as one single photoreceptor in the phase detection and the phase adjustment.

6. The image forming apparatus according to claim 1, further comprising:

a reference photoreceptor setting unit configured to specify one of the plurality of photoreceptors as a reference photoreceptor for adjusting the respective phases of the plurality of photoreceptors.

7. The image forming apparatus according to claim 6, wherein the reference photoreceptor setting unit is configured to specify the reference photoreceptor in accordance with a request from one of a local apparatus and a remote apparatus via a network.

8. The image forming apparatus according to claim 6, further comprising:

a first storing unit configured to store a value specified by the reference photoreceptor setting unit.

9. The image forming apparatus according to claim 8, wherein the reference photoreceptor setting unit is configured to specify the reference photoreceptor in accordance with a request from one of a local apparatus and a remote apparatus via a network.

10. The image forming apparatus according to claim 1, further comprising:

a phase difference setting unit configured to specify respective phase differences of respective non-reference photoreceptors with respect to a reference photoreceptor.

11. The image forming apparatus according to claim 10, wherein the phase difference setting unit is configured to specify the phase difference in accordance with a request from one of a local apparatus and a remote apparatus via a network.

12. The image forming apparatus according to claim 10, further comprising:

a second storing unit configured to store values specified by the phase difference setting unit.

13. The image forming apparatus according to claim 12, wherein the phase difference setting unit is configured to specify the phase difference in accordance with a request from one of a local apparatus and a remote apparatus via a network.

14. An image forming apparatus, comprising:

a plurality of photoreceptors configured to bear respective images on respective surfaces thereof;

a phase detecting unit configured to perform a phase detection so as to detect respective phases of the plurality of photoreceptors;

means for performing a phase adjustment for adjusting the respective phases of the plurality of photoreceptors to become in predetermined correlated phase relationships, based on an output from the phase detecting unit; and means for specifying a first form of an image forming operation in which the phase detecting unit performs the phase detection during a printing operation, and the means for performing the phase adjustment while the plurality of photoreceptors are rotating after a completion of the printing operation so that the plurality of photoreceptors are stopped in the predetermined correlated phase relationships.

15. The image forming apparatus according to claim 14, wherein the means for specifying further specifies a second form of an image forming operation in which the phase detecting unit performs the phase detection prior to a start of the printing operation, the means for performing the phase adjustment adjusts the respective phases of the plurality of photoreceptors to become the predetermined correlated phase relationships, and the printing operation is started after the phase adjustment.

16. The image forming apparatus according to claim 15, wherein the means for specifying further selects one of the first and second forms of image forming operations in accordance with a setting input to the means for specifying.

17. A method of adjusting a plurality of photoreceptors included in an image forming apparatus, comprising:

receiving a request of printing an image from one of a local apparatus and a remote apparatus via a network;

rotating the plurality of photoreceptors; and performing one of first and second forms of image forming operations based on a setting specified in the request, the first form comprising:

detecting respective phases of the plurality of photoreceptors during a printing operation;

adjusting the respective phases of the plurality of photoreceptors to become in predetermined correlated phase relationships, based on the detecting, while the plurality of photoreceptors are rotating after a completion of the printing operation; and stopping the plurality of photoreceptors in the predetermined correlated phase relationships;

the second form comprising:

detecting the respective phases of the plurality of photoreceptors prior to a start of the printing operation;

adjusting the respective phases of the plurality of photoreceptors to become in predetermined correlated phase relationships, based on the detecting; and starting the printing operation.

18. The method according to claim 17, further comprising:

specifying a reference photoreceptor;

storing a value for the reference photoreceptor;

specifying respective phase differences of respective non-reference photoreceptors with respect to the reference photoreceptor; and storing values for the respective non-reference photoreceptors.

19. A computer program product stored on a computer readable storage medium for carrying out a method of adjusting a plurality of photoreceptors, when running on an image forming apparatus, the method comprising:

receiving a request of printing an image from one of a local apparatus and a remote apparatus via a network;

rotating the plurality of photoreceptors; and performing one of first and second forms of image forming operation based on a setting specified in the request, the first form comprising:

detecting respective phases of the plurality of photoreceptors during a printing operation;

adjusting the respective phases of the plurality of photoreceptors to become in predetermined correlated phase relationships, based on the detecting, while the plurality of photoreceptors are rotating after a completion of the printing operation; and stopping the plurality of photoreceptors in the predetermined correlated phase relationships; and the second form comprising:

detecting the respective phases of the plurality of photoreceptors prior to a start of the printing operation;

adjusting the respective phases of the plurality of photoreceptors to become in predetermined correlated phase relationships, based on the detecting; and starting the printing operation.

20. The computer program product according to claim 19, the method further comprising:

specifying a reference photoreceptor;

storing a value for the reference photoreceptor;

specifying respective phase differences of respective non-reference photoreceptors with respect to the reference photoreceptor; and storing values for the respective non-reference photoreceptors.

* * * * *